US005190293A

United States Patent [19]

Cabrera

[11] Patent Number: 5,190,293

[45] Date of Patent: Mar. 2, 1993

[54] ELECTION GAME APPARATUS

[76] Inventor: Flavio M. Cabrera, Calle 119 A No. 53 A 85, Bogotá (Niza), Colombia

[21] Appl. No.: 858,044

[22] Filed: Mar. 26, 1992

[51] Int. Cl.[5] ..... A63F 3/04; A63F 9/04

[52] U.S. Cl. ..... 273/257; 273/145 B

[58] Field of Search ..... 273/257, 276, 279, 256, 273/145 R, 145 B

[56] References Cited

U.S. PATENT DOCUMENTS

| | | | |
|---|---|---|---|
| 993,392 | 5/1911 | Miller | 273/145 B |
| 3,368,816 | 2/1968 | Milázzo et al. | 273/257 |
| 3,468,540 | 9/1969 | Mulligan | 273/276 |
| 5,100,141 | 3/1992 | Fitch | 273/145 B |

*Primary Examiner*—Benjamin H. Layno
*Attorney, Agent, or Firm*—Leon Gilden

[57] ABSTRACT

A game apparatus includes a game board formed with a perimeter of spaces to include a central space having a puzzle configuration representative of a United States map, with each of the states interfitting relative to the puzzle. Individual players are directed about the game board path, and upon landing of various spaces are directed to elect various mayoral representative figures for each state, with each state being provided with a predetermined number of mayoral representatives. A player with a greatest number of mayoral representatives in a certain state is directed to effect control of the election of governor and subsequently, control of the state's electoral votes for subsequent voting of a president, with each player representing a different political party. Dice members and a dice member agitation device is arranged for use by the invention.

2 Claims, 4 Drawing Sheets

ELECTION GAME APPARATUS

BACKGROUND OF THE INVENTION

1. Field of the Invention

The field of invention relates to game apparatus, and more particularly pertains to a new and improved election game apparatus wherein the same is directed to the election of political parties and representatives.

2. Description of the Prior Art

While the prior art has been arranged to related interplay of an electoral college relative to an election of President, the prior art has heretofore failed to provide for the visual appreciation relative to the undertaking in the political process to effect such election. An example of such intellectual game is set forth in the U.S. Pat. No. 4,085,938 that in turn utilizes a map with individual state components being arranged to be positioned within the map structure.

U.S. Pat. No. 1,616,216 to Dempsey sets forth a game apparatus utilizing various state components indicating when such state was admitted into the Union.

U.S. Pat. No. 4,085,938 to Bean, Jr. sets forth a further example of election game utilizing dice members to direct interplay of the game structure.

Further, political game apparatus is set forth in the U.S. Pat. No. 1,907,255 to Ferrari, Jr. and 753,949, as well as the patent 3,525,526 to Kenrick setting forth a board game for simulating Presidential election.

As such, it may be appreciated that there continues to be a need for a new and improved election game apparatus as set forth by the instant invention which addresses both the problems of ease of use as well as effectiveness in construction in providing visual representation of election of various components of the political process and election of President and in this respect, the present invention substantially fulfills this need.

SUMMARY OF THE INVENTION

In view of the foregoing disadvantages inherent in the known types of game apparatus now present in the prior art, the present invention provides an election game apparatus wherein the same directs players to effect election of mayors, governors, and President of the United States. As such, the general purpose of the present invention, which will be described subsequently in greater detail, is to provide a new and improved election game apparatus which has all the advantages of the prior art game apparatus and none of the disadvantages.

To attain this, the present invention provides a game apparatus including a game board formed with a perimeter of spaces to include a central space having a puzzle configuration representative of a United States map, with each of the states interfitting relative to the puzzle. Individual players are directed about the game board path, and upon landing of various spaces are directed to elect various mayoral representative figures for each state, with each state being provided with a predetermined number of mayoral representatives. A player with a greatest number of mayoral representatives in a certain state is directed to effect control of the election of governor and subsequently, control of the state's electoral votes for subsequent voting of a president, with each player representing a different political party. Dice members and a dice member agitation device is arranged for use by the invention.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved election game apparatus which has all the advantages of the prior art game apparatus and none of the disadvantages.

It is another object of the present invention to provide a new and improved election game apparatus which may be easily and efficiently manufactured and marketed.

It is a further object of the present invention to provide a new and improved election game apparatus which is of a durable and reliable construction.

An even further object of the present invention is to provide a new and improved election game apparatus which is susceptible of a low cost of manufacture with regard to both materials and labor, and which accordingly is then susceptible of low prices of sale to the consuming public, thereby making such election game apparatus economically available to the buying public.

Still yet another object of the present invention is to provide a new and improved election game apparatus which provides in the appratuses and methods of the prior art some of the advantages thereof, while simulatneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
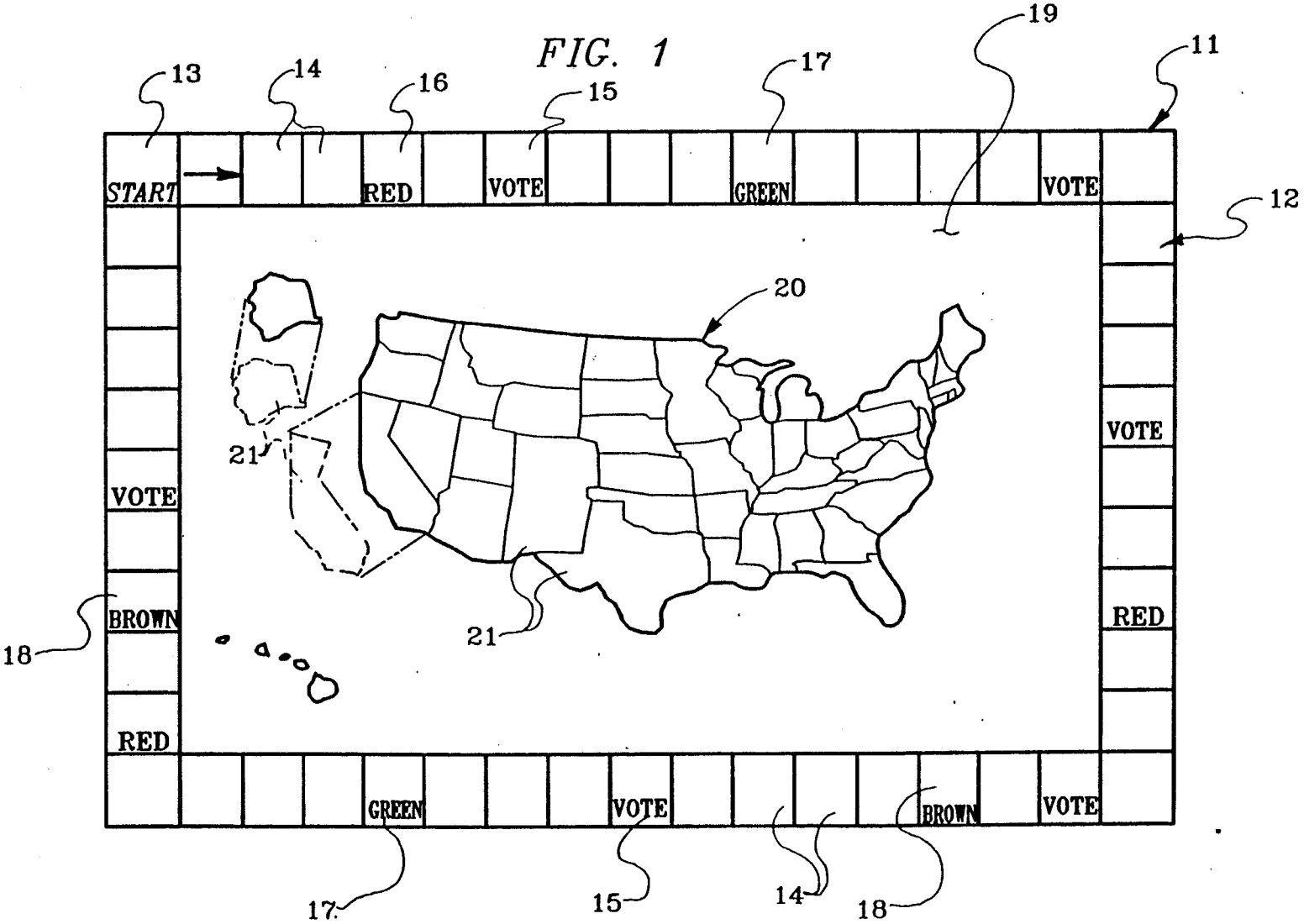
FIG. 1 is an orthographic view of the game board of the invention.
Figure 2:
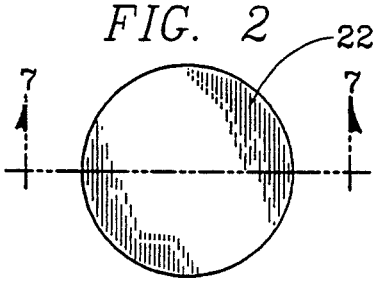
FIG. 2, FIG. 3, FIG. 4, FIG. 5, and FIG. 6 are top orthographic views of contrastingly colored tokens utilized by individual players in association with contrasting political parties.
Figure 3:
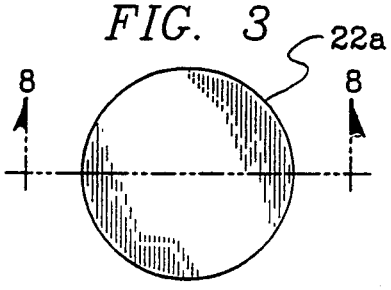
Figure 4:
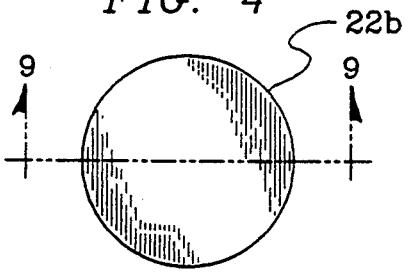
Figure 5:
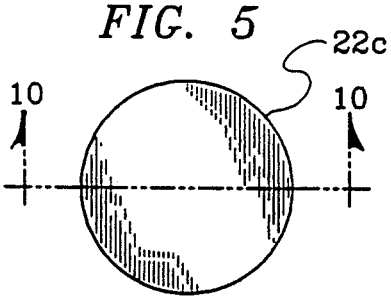
Figure 6:
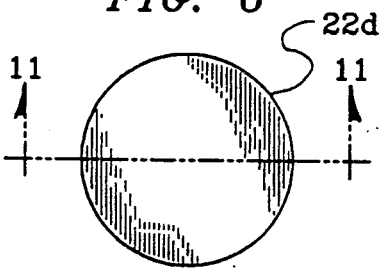
Figure 7:
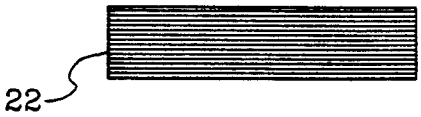
FIG. 7, FIG. 8, FIG. 9, FIG. 10, and FIG. 11 are orthographic cross-sectional views, taken along the lines 7—7 of FIG. 2, 8—8 of FIG. 3, 9—9 of FIG. 4, 10—10 of FIG. 5, and 11—11 of FIG. 6 respectively.
Figure 8:
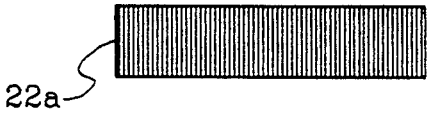
Figure 9:
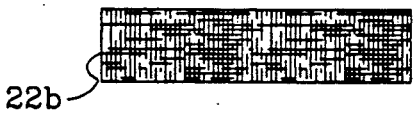
Figure 10:
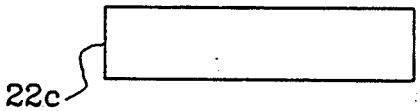
Figure 11:
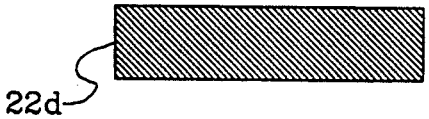
Figure 12:
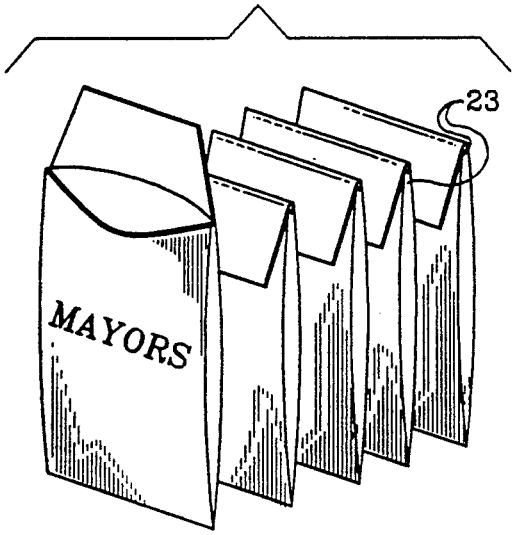
FIG. 12 is an isometric illustration of mayoral bag members utilized by the invention.
Figure 15:
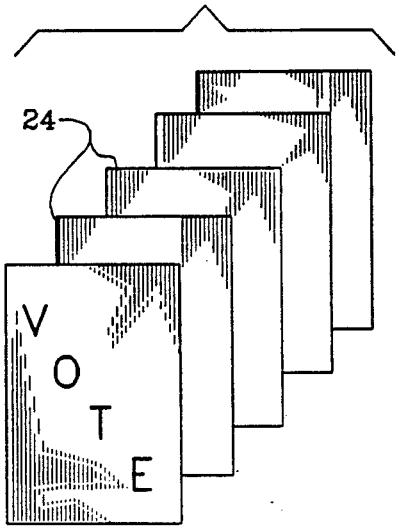
FIG. 15 is a top orthographic view of representative vote cards utilized by the invention.
Figure 13:
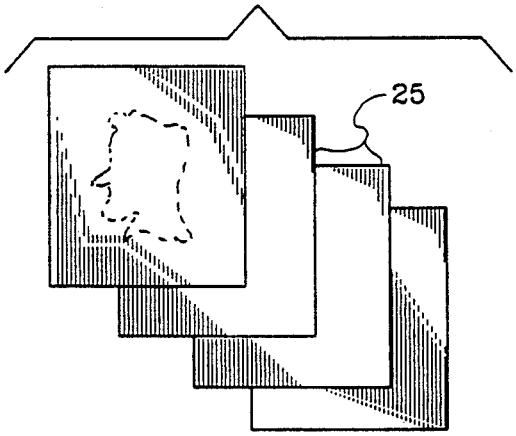
FIG. 13 is a top orthographic view of representative mayoral cards utilized by the invention.
Figure 16:
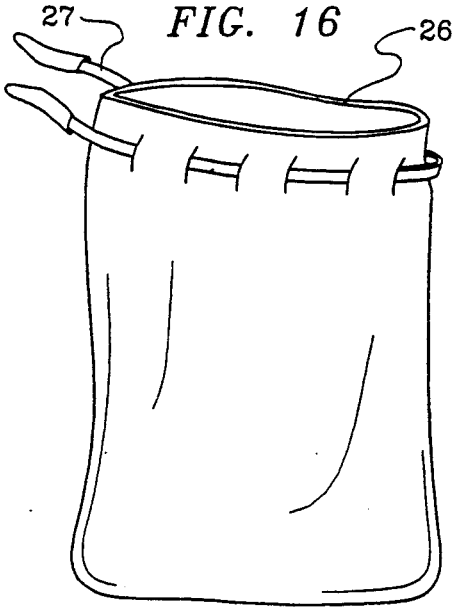
FIG. 16 is an isometric illustration of a shuffling bag utilized by the invention.
Figure 14:
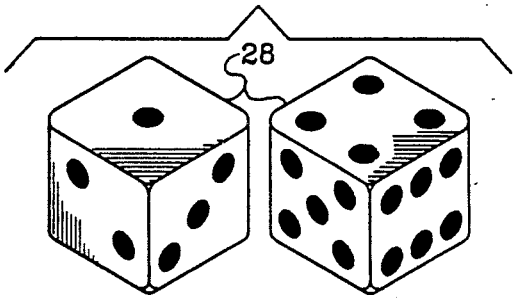
FIG. 14 is an isometric illustration of the dice members utilized by the invention.

With reference now to the drawings, and in particular to FIGS. 1 to 18 thereof, a new and improved election game apparatus embodying the principles and concepts of the present invention and generally designated by the reference numerals 11-40 will be described.

More specifically, the election game apparatus of the invention essentially comprises a game board 11 formed with a top surface that includes a perimeter path of spaces 12 directed about the top surface in a continuous relationship. The path of spaces 12 includes a start space 13, wherein each of a plurality of two to five players is to be directed at an origination point. The path includes at varying intervals, first spaces 14 that are blank, second spaces 15 that are depicted as "vote spaces" that may include spaces for a "double vote", to be described below, wherein the players are directed to vote for various candidates. The use of third spaces 16 or "penalty spaces" that are designated as "red". Fourth spaces 17 are designated as "reward spaces" and are depicted as "green spaces". Fifth spaces 18 are special award spaces or "brown spaces". A central area 19 within the path of spaces 12 on the top surface includes a United States puzzle map 20, wherein each of the components of the puzzle map are of individual state puzzle components 21, such as indicated in phantom and by the solid line indication relative to the puzzle map, wherein variously colored puzzles for each political party are provided. For example as the game apparatus contemplates the use of five political parties, each player is awarded a puzzle component in a harmonious coloration relative to that political party. Accordingly, five state components are provided for each state, with each component of a differing coloration with a single coloration awarded each competing player or political party. The players are each provided a token (see FIGS. 2-11), wherein each player includes a token coloration consistent with a designated political party. The tokens 22, *22a*, *22b*, *22c*, and *22d* are of those colorations. For example, the game contemplates that the first token be of a blue designation for "Republicans", red tokens for "Democrats", green tokens representing "Ecologists", yellow tokens for "Technocrats", and white tokens for "Passivists". It may be seen therefore that the tokens 22, *22a*, *22b*, *22c*, and *22d* as indicated in the FIGS. 7, 8, 9, 10, and 11 are associated in arbitrary form relative to each political party. This contrasting coloration is maintained relative to each player, wherein each player for example such as a white token includes white state components 21 for positioning within a map. In this manner, visual indication of the political party garnering political power in controlling various states is effected.

The game includes mayoral envelopes 23, wherein each envelope includes the associated mayoral cards 25 of the various colorations. In this manner, each player is awarded the same number of mayoral cards relative to each envelope, wherein as the players elect mayors, the various political party electing a mayor draws that mayor from the envelope. A shuffling bag 26 is provided, wherein the shuffling bag 26 is arranged to receive associated vote cards 24 such that each player upon a player landing upon a vote space or second space 15 draws a vote card from the bag 26, with the bag 26 including a drawstring 27 to enhance ease of containment of the vote cards therewithin. A plurality of dice members 28 are provided to effect directing of players about the path of spaces 12, with each indicia directing a movement of one space.

Figure 17:
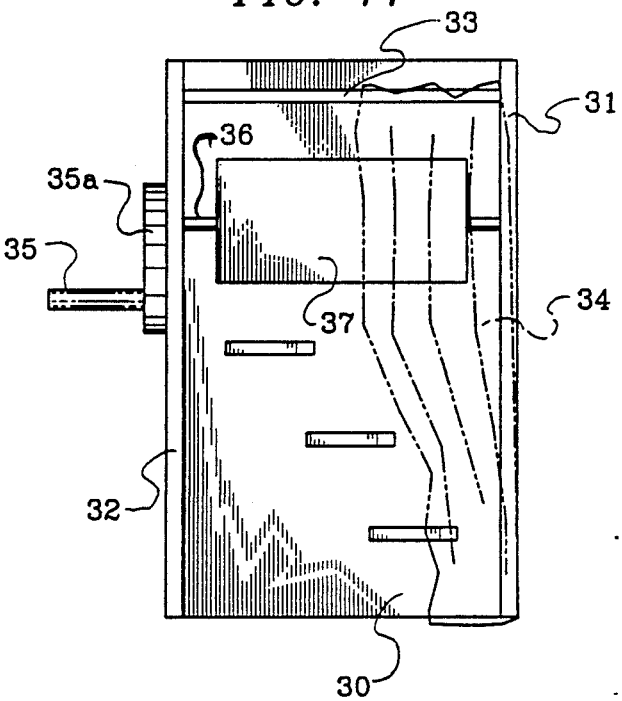
FIG. 17 is an orthographic frontal view of a dice voting booth.
Figure 18:
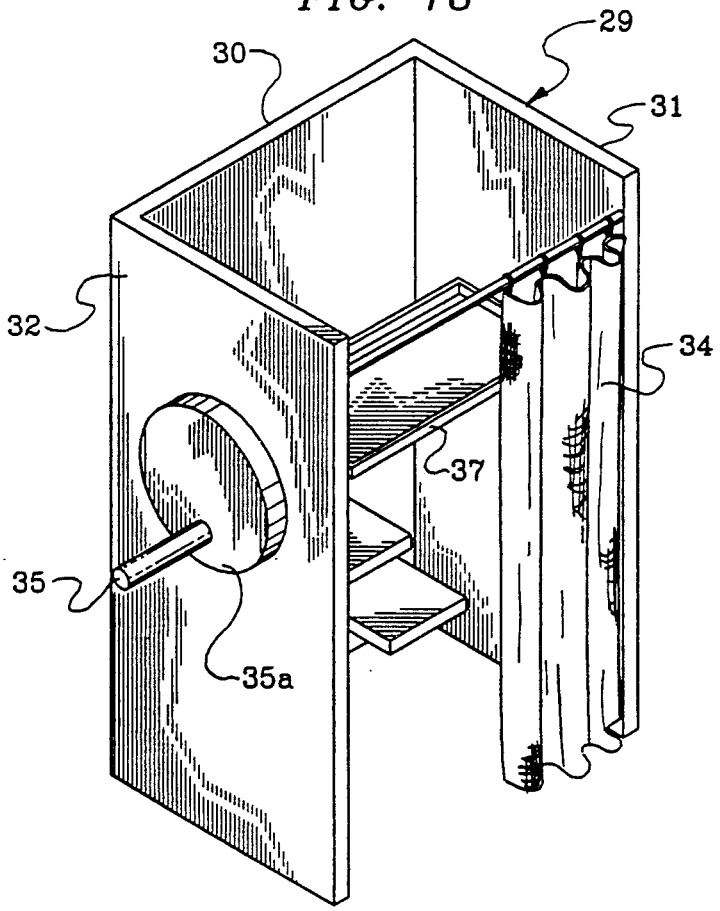
FIG. 18 is an isometric illustration of the dice voting booth.

To enhance enjoyment and amusement of the game, a shuffling voting booth 29 is provided, as illustrated in the FIGS. 17 and 18. The shuffling voting booth includes a rear wall 30, a first side wall 31, and a second side wall 32 to define a "U" shaped configuration, with the first and second side walls 31 and 32 arranged in a parallel relationship relative to one another extending orthogonally and forwardly of the rear wall 30. A curtain rod 33 extends across the first and second side walls 31 and 32 in a parallel spaced relationship relative to the rear wall 30, with the curtain including a flexible curtain 34 mounted thereon to contain dice members positioned upon a support plate 37 within the booth. A crank handle 35 is provided that is eccentrically mounted to an axle 36. The axle 36 is coaxial of and orthogonally intersecting an axle plate *35a* mounted to an exterior surface of the second side wall 32 that eccentrically receives the crank handle 35. Rotation of the crank handle 35 effects displacement of the support plate 37 from a first horizontal orientation orthogonally oriented relative to the rear wall 30 to a second position or orientation arranged parallel relative to the rear wall 30 to direct the dice members positioned upon the support plate 37 downwardly. Upon the dice members being projected downwardly, a plurality of abutment plates, including a first, second, and third abutment plate 38, 39, and 40, are orthogonally mounted to the rear wall projecting forwardly thereof. The abutment plates are each laterally displaced relative to one another positioned below the support plate to effect agitation of the dice members as they are directed downwardly from the support plate. The abutment plates are of a predetermined length less than the predetermined width defined by the side walls to permit the dice members to be directed downwardly beyond the abutments plates 38–40 between the abutment plates and the flexible curtain 34. Opening of the curtain 34 permits visual inspection of the dice members and dice member digits thusly attained.

A representative manner of playing the election game apparatus of the invention contemplates utilization of the game, wherein the variously depicted political parties by the variously aforenoted colorations initiate play of the game by utilizing the dice members 28 to ascertain sequence of play among the various players by utilizing such techniques as highest score going first, and so forth.

Additionally, in election of mayors, votes of the vote cards 24 are positioned within the shuffling bag 26. The players elect mayors each time that any player lands on a completed turn upon a second space or "vote space" 15. That player landing upon such space extracts five of the vote cards 24 subsequent to their being shuffled. The vote cards are of 364 in number, wherein 350 of the vote cards are directed to individual cities within the states of the map 20. Fourteen of the vote cards are special vote cards, wherein six of the special vote cards are denoted by the term "null vote". A player directing such a card loses an option to elect a mayor. A remaining of such special vote cards includes the term "special space vote". A player selecting such a card is rewarded in that the player may elect a governor in any state where a governor has not been elected for garnering associated electoral votes of that state. The third spaces 16 are penalty spaces directing a player to be directed backwards three squares. Further, the player is arbitrarily directed to loose one or two turns to be decided by the players prior to commencing play of the game. The fourth spaces 17 are reward spaces that directs a player to advance three spaces with subsequent space 15. Spaces 18 or the "brown space" are such that the player may extract seven votes of the vote cards 24 from the bag 26 during a voting procedure. A listing (not shown) of an electoral square or listing of the various mayors positioned available within each state is provided. A player having drawn various mayors during a voting procedure and having a greatest number of votes has a correspondingly colored mayoral card 25 and that player then checks an associated electoral square for indication of having control of that mayor subsequent to a voting of such mayors when the players land upon a second space 15. The election of governors is controlled by a player having controlled the greatest number of mayors within a particular state. Having thusly been able to capture control of a state by the mayors in controlling the governor, the player that thusly controls electtoral votes of that state to be arbitrarily decided. Further, each state is to be arbitrarily provided with seven mayoral candidates to be elected. Should there be a state where there is no majority of mayors being controlled by an individual player, the dice members may be thrown a plurality of times and the results of the cumulative total of the dice throws effects a tie breaker relative to the election of governor. Further, each of the vote cards 24 have depicted a coloration and a city or town in each of the states relative to a particular mayor of each town. As each player is directed to draw from the 364 vote cards afforded each player, a player having garnered at each voting session when a player lands upon a second space a mayoral candidate, that mayoral candidate is awarded to that player for subsequent election of governor as noted above. In instances where votes remain in the shuffle bag 26 of the vote cards 24, a governor has already been elected in a particular state, a player may continue to draw from the bag until votes relative to a state relative where a governor has not been elected may be withdrawn.

It is understood that variations in play of the game utilizing the apparatus may be employed by players participating in the game to be decided and accordingly, the manner of usage and operation of the instant should be understood from the above disclosure relative to the presentation of the apparatus therewithin in directing players about the game board and as such, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An election game apparatus, comprising, a game board, the game board including a perimeter path of continuous spaces, the perimeter path includes a start space, a plurality of first spaces that are blank, a plurality of second spaces that are indicating voting of players, a plurality of third penalty spaces, a plurality of fourth reward spaces, and a plurality of fifth special award spaces within the game path, and a central area on the game board within the central area, and a puzzle map representing a country, said puzzle map located in the central area, and a predetermined number of contrastingly colored tokens to include a first, second, third, fourth, and fifth coloration, and a plurality of sets of state puzzle components, each set of state puzzle components comprising a plurality of state puzzle components representing all the states of the country wherein each state puzzle component is configured to represent an individual state and to be placed within the puzzle map, the state puzzle components in any one set all having the same uniform color and the sets of state puzzle components are contrastingly colored from one another wherein each state is represented by contrastingly colored state puzzle components to include a first, second, third, fourth, and fifth coloration of state puzzle components associated with the respective first, second, third, fourth, and fifth tokens, and a predetermined number of vote cards, each vote card having indicia representing a city within a state and each state having a plurality of cities wherein each city is individually represented by a vote card and a bag member, for the predetermined number of vote cards to be placed therein, and a plurality of mayoral cards, wherein the mayoral cards are equal to the predetermined the plurality of mayoral cards divided into contrastingly colored sets to include a first, second, third, forth and fifth coloration of sets of mayoral cards associated with the respective first, second, third, forth and fifth token number, and dice members for directing players about the perimeter path of spaces, wherein each player is afforded one of said tokens, and upon a player and a token landing upon a second space, the player is directed to withdraw a further predetermined number of vote cards from said bag member, and a player landing upon one of said third spaces is directed to loose at least one turn, said player landing upon a fourth space is directed to advance a plurality of spaces, and said player landing upon one of said fifth spaces is directed to draw a yet further predetermined number of vote cards from said bag member.

2. An apparatus as set forth in claim 1 including a dice member voting booth, the dice member voting booth including a rear wall, and a first side wall spaced from and parallel a second side wall, wherein the first side wall and second side wall are orthogonally oriented relative to the rear wall, and a curtain rod mounted to the first side wall and the second side wall at an upper distal end of the first side wall and the second side wall arranged parallel to the rear wall and spaced from the rear wall a predetermined spacing substantially equal to a predetermined width defined by the first side wall and second side wall, and arranged to include a flexible curtain mounted to the curtain rod slidably therealong, and an axle orthogonally directed through the first side wall and second side wall rotatably mounted within the first side wall and second side wall, including a support plate mounted fixedly to the axle, with the support plate extending between the first side wall and the second side wall, and the axle including an axle plate orthogonally mounted to the axle, with the axle plate positioned exteriorly of the second side wall, the axle plate including a crank handle orthogonally mounted to the axle plate eccentrically relative to the axle plate and parallel to and displaced relative to the axle, and the support plate arranged for reception of the dice members thereon, and a first abutment plate and a second abutment plate orthogonally mounted to the rear wall extending forwardly of the rear wall and below the support plate, wherein the first abutment plate and second abutment plate are of a plate length less than the predetermined width of said first side wall and second wall, wherein the first abutment plate and the second abutment plate are positioned below the support axle laterally displaced relative to one another to provide for abutment of dice members directed from the support plate, wherein the support plate is rotatable from a first position orthogonally oriented relative to the rear wall to a second position oriented parallel relative to the rear wall to direct the dice members onto the first abutment plate and the second abutment plate.

* * * * *